United States Patent [19]

Page

[11] Patent Number: 4,466,391

[45] Date of Patent: Aug. 21, 1984

[54] STARTING AIDS FOR INTERNAL COMBUSTION ENGINES

[75] Inventor: Kenneth Page, Sheldon, England

[73] Assignee: Lucas Industries public limited company, Birmingham, England

[21] Appl. No.: 414,592

[22] Filed: Sep. 3, 1982

[30] Foreign Application Priority Data

Sep. 23, 1981 [GB] United Kingdom ..... 8128714

[51] Int. Cl.[3] ..... F23Q 7/22; F02P 19/02

[52] U.S. Cl. ..... 123/145 A; 219/270; 361/266

[58] Field of Search ..... 123/145 A, 179 H; 219/270, 267; 361/264, 265, 266

[56] References Cited

U.S. PATENT DOCUMENTS

| | | | |
|---|---|---|---|
| 3,434,012 | 3/1969 | Rademacher | 123/145 A |
| 4,080,944 | 3/1978 | Bhat et al. | 123/145 A |
| 4,292,934 | 10/1981 | Knowles | 123/145 A |
| 4,359,977 | 11/1982 | Sperner et al. | 123/145 A |

FOREIGN PATENT DOCUMENTS

| | | | |
|---|---|---|---|
| 60885 | 10/1923 | Sweden | 123/145 A |

*Primary Examiner*—Andrew M. Dolinar

[57] ABSTRACT

An electric starting aid for a compression ignition engine includes a central conductive rod housed within a hollow extension secured to a body part. The rod has a tapered portion at least part of which extends beyond the extension and about which a conductive tape forming a heating element is wound in helical overlapping relationship. A fused glass filling supports the rod and element within the extension.

9 Claims, 2 Drawing Figures

STARTING AIDS FOR INTERNAL COMBUSTION ENGINES

Figure 1:
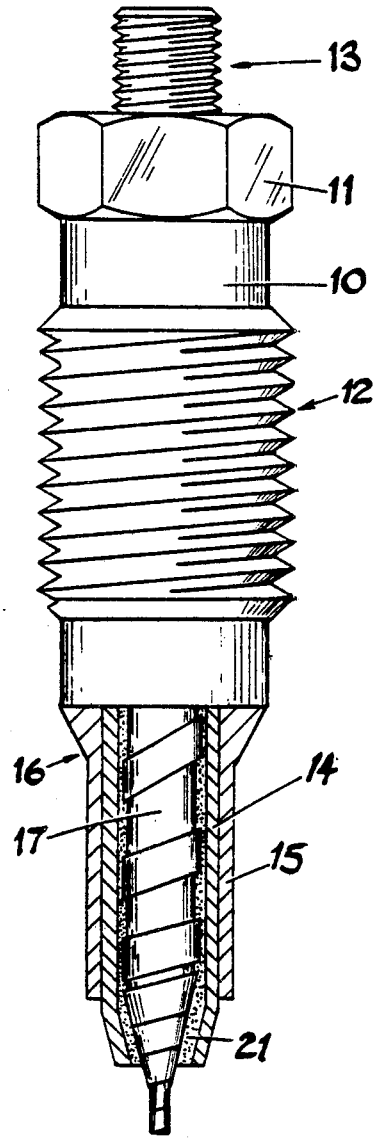

This invention relates to electric starting aids for use in the combustion chambers of compression ignition engines, the aids being of the kind comprising a body part mounting a terminal assembly, a tubular extension carried by the body part, the extension in use extending within a bore in the cylinder head of the engine with the end of the extension remote from the body part being exposed within the combustion chamber, a coiled electric heating element located at said end of the extension and an electrically conductive rod extending within the extension to said end thereof, said rod being electrically connected to one end of the heating element and to said terminal assembly, the other end of the element being electrically connected to said extension.

Such starting aids have the advantage over the type of aid in which the heating element is fully enclosed in a closed tubular member, in that the aid becomes effective to facilitate the starting of the engine almost as soon as it is connected to an electric supply. One disadvantage is that the heating element is subject to the extreme conditions within the combustion chamber all the time the engine is in operation.

One form of such an aid is described in British Patent Specification No. 1,127,454. In this case the electric heating element is in the form of a spiral which is wound about the conductive rod and is located within the one end of the tubular extension. Adjacent the element is a ceramic bead which extends about the rod and the rod is supported within the extension by means of a fused glass filling which also establishes a gas tight seal.

In order to extend the working life of the starting aid it has been proposed to join the outer end of the heating element to the extension at a position removed from the heating element itself. Such an aid is described in British Patent Specification No. 1,565,194. This is achieved by folding the outer end portions of the heating element through substantially 90° and securing the end of the element to the extension at or adjacent the other end of the extension. This technique has extended the life of the aid but since the conditions of operation in modern compression ignition engines are becoming more severe, aids have failed due to fracture of the element at the joints with the rod and extension.

The object of the invention is to provide an aid of the kind specified in an improved form.

According to the invention in a starting aid of the kind specified said rod has a tapered portion adjacent said end of the extension and said heating element is formed from conductive tape and is wound from the free end of said rod, in helical overlapping relationship along at least part of said tapered portion of the rod.

According to a further feature of the invention the winding of the tape along the non-tapered portion of the rod is in a non-overlapping relationship.

Figure 2:
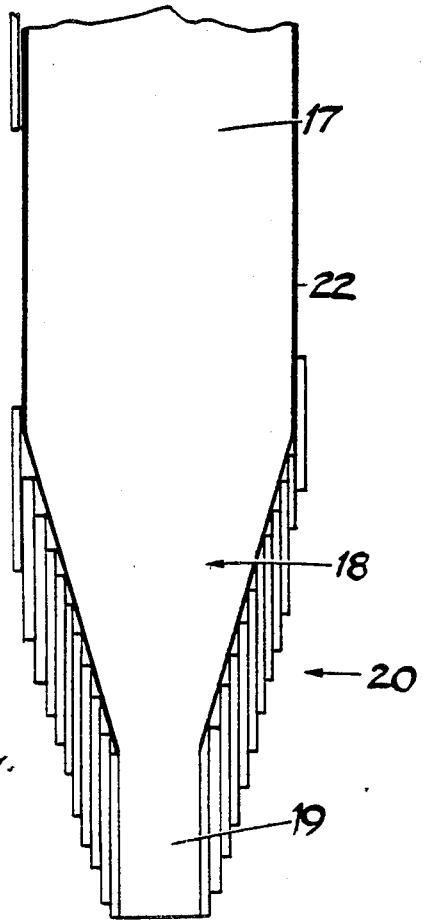

An example of a starting aid in accordance with the invention will now be described with reference to the accompanying drawings in which:

FIG. 1 is a side view of the aid with a portion thereof shown in section, and FIG. 2 is a sectional view to an enlarged scale of part of the air seen in FIG. 1.

Referring to the drawings the starting aid comprises a body part 10 of generally cylindrical form but having a hexagonal portion 11 and a screw threaded portion 12.

The threaded portion in use, engages with a complementary thread formed in a bore in the cylinder head of the associated engine. The body part in addition, mounts a terminal 13 which in use, is connected to one terminal of an electric supply, the other terminal of the supply being connected to the body part by way of the engine structure.

Extending from the body part is a tubular extension 14 which is formed from metal and which locates within a recess formed in the body part 10. The tubular extension is surrounded by a hollow cylindrical shroud 15 the shroud having a flared portion 16 which in use, seats against a seating in the bore in the engine.

Extending within the extension 14 is an electrically conductive rod 17 which is electrically connected to the terminal 13 either directly or by way of a ballast resistor. The rod 17 has a tapered portion 18 and a cylindrical portion 19. The cylindrical portion and a small length of the tapered portion 18 extend beyond the extension and the latter has its end portion which projects beyond the shroud 15, of tapering form.

Wound about the rod is an electric heating element generally indicated at 20. The heating element is formed from conductive metal tape conveniently in 80/20 nickel chromium alloy. The tape is wound in helical fashion about the rod and it is secured at its inner end, to the cylindrical portion 19 as for example by spot welding. The tape is then wound in helical overlapping relationship over at least a part of the length of the tapered portion 18 of the rod. The winding of the tape is continued in non-overlapping relationship towards the end of the rod adjacent the body part and it is secured to the wall of the extension 14.

The rod and heating element are located within the extension by means of a fused glass filling which is indicated at 21, the filling extending to the end of the extension remote from the body part 10. An important aspect of the invention is that the rod is positively located within the extension throughout the length of the latter and a further important aspect of the construction is that the diameter of the rod 17 is only slightly smaller than the internal diameter of the extension. The difference in diameters is such as to allow the tape to be wound about the rod whilst at the same time allowing sufficient clearance for the glass to flow between the tape and the internal wall of the extension so as to seal the assembly.

It will be noted also from FIG. 2 of the drawings that the maximum internal diameter of the helical overlapped portion of the element is substantially equal to the diameter of the rod. This ensures that the tape is supported by the rod throughout its length.

The steps in the construction of the rod/element/extension assembly will now be described. Since the tape is wound about the rod it is necessary for it to be electrically insulated from the rod and this is achieved by first providing the rod with an enamel coating, this being indicated at 22 in FIG. 2. Conveniently the enamel used to provide the coating is a chromium based enamel which is capable of withstanding temperatures in the region of 1000° C. A suitable enamel is that sold under the name SOLARAMIC ENAMEL by Ferro (G. B.) Ltd., Ounsdale Road, Wombourne, Wolverhampton. The enamel after it has been applied to the rod is fired so as to provide a hard coating. During the application of the enamel the cylindrical portion 19 and the remote end portion of the rod are masked to prevent them being coated with the enamel alternatively, these portions of the rod may be gritblasted after the coating has been fired. The purpose of this is to be able to secure as by spot welding, the tape as will be described.

The next operation is to wind the tape onto the rod. As mentioned above, the tape is a nickel chromium alloy but before it is wound upon the rod it is provided with a nickel coating which is oxidised to provide an electrically insulating nickel oxide surface layer. The end of the tape after the oxide layer has been removed, is spot welded to the portion 19 of the rod, the tape being joined at a slight angle. Following the joining operation the tape is wound about the rod and as will be seen from FIG. 2, the tape is wound in a helical fashion in overlapping relationship. In the particular example the whole of the length of the tapered portion 18 is provided with overlapped tape. The winding is further continued to the end of the rod remote from the cylindrical portion 19 in a non-overlapping fashion and the tape is temporarily attached to the uncoated end of the rod by spot welding. The tape is then severed. The fact that the tape is secured to the end of the rod is merely to prevent it unwinding.

The rod with the tape is then inserted into the extension into which has previously been inserted a glass tube which provides the filling and which acts to locate the rod within the extension. The assembly is then heated to fuse the glass, the temperature required being of the order of 1000° C. When the glass has fused, the assembly is allowed to cool and the end of the tape remote from the cylindrical portion 19 of the rod, is severed from the rod and is spot welded to the extension. Finally, the assembly is fitted into the body part and a brazing process carried out to secure the extension to the body part. The shroud 15 can then be fitted and the rod 17 connected to the terminal 13. In the aid as described, the rod 17 is provided with support throughout most of its length and also is of larger diameter than in the known constructions mentioned above. It is therefore better able to withstand lateral vibration due to pressure shock waves within the combustion chamber. Moreover, it has an increased thermal shock and it minimises softening of the glass. At the same time however a portion of the heating element is exposed directly to the combustion chamber thereby retaining the rapid heating capability of this type of starting aid. It is not essential that the rod should be of constant diameter over that portion which lies between the tapered portion 18 and the end which is connected to the terminal. At least that portion adjacent the tapered portion should be of the diameter discussed above. If the diameter is to vary then it should do so in a gradual manner so that the tape is properly supported on the rod. In the particular example, the important dimensions of the aid are as follows, the diameter of the rod 17 is 3.2 mm and the length of the portion of the rod projecting from the body 10 is between 20 mm and 25 mm. The external diameter of the shroud 15 is 7 mm and the axial length of the tapered portion 18 of the rod is 5 mm, the included angle of its surface being between 20° and 40°. The diameter of the cylindrical portion 19 is 1 mm and the length of the portion of the rod projecting beyond the extension 14 is 2 mm.

I claim:

1. An electric starting aid for use in a combustion chamber of a compression ignition engine and comprising a body part mounting a terminal assembly, a tubular extension carried by the body part, the end of the extension remote from the body part being exposed in use within the combustion chamber, a coiled electric heating element formed by a length of conductive tape located at said end of the extension and an electrically conductive rod extending within the extension to said end thereof, said rod having a free end and being electrically connected to one end of the tape forming the heating element and to said terminal assembly, the other end of the tape forming the heating element being electrically connected to said extension, said rod having a tapered portion adjacent said end of the extension and said heating element being wound from the free end of the rod in helical overlapping relationship along at least part of said tapered portion of the rod.

2. A starting aid according to claim 1, in which the tape is wound along a non-tapered portion of the rod in non-overlapping relationship.

3. A starting aid according to claim 1 or claim 2 in which the extension overlaps part of the tapered portion of the rod.

4. A starting aid according to claim 3 in which the end portion of the extension which overlaps said tapered portion of the rod is of tapering form.

5. A starting aid according to claim 4, including a fused glass filling which is located between the inner wall of the extension and the rod, said filling acting to locate the rod together with the heating element within the extension.

6. A starting aid according to claim 2, in which said rod at its free end defines a cylindrical portion, said tape being secured to said cylindrical portion of the rod.

7. A starting aid according to claim 6 including an electrically insulating coating on the rod, and a further electrically insulating coating on said tape.

8. A starting aid according to claim 1 in which the included angle of the tapered portion of the rod is between 20° and 40°.

9. A starting aid according to claim 1 in which the maximum internal diameter of the helical overlapped portion of the element is subtantially equal to the diameter of the rod.

* * * * *